US007467581B2

(12) United States Patent
Botty

(10) Patent No.: US 7,467,581 B2
(45) Date of Patent: Dec. 23, 2008

(54) SEMI-AUTOMATIC RIFLE

(75) Inventor: Alain Botty, Ayeneux (BE)

(73) Assignee: Browning International, Societe Anonyme, Herstal (BE)

( * ) Notice: Subject to any disclaimer, the term of this patent is extended or adjusted under 35 U.S.C. 154(b) by 27 days.

(21) Appl. No.: 11/585,221

(22) Filed: Oct. 24, 2006

(65) Prior Publication Data

US 2007/0131104 A1 Jun. 14, 2007

(30) Foreign Application Priority Data

Oct. 25, 2005 (BE) ..... 2005/0524

(51) Int. Cl.
*F41A 5/10* (2006.01)
*F41A 5/18* (2006.01)

(52) U.S. Cl. ..... 89/193; 89/191.02; 89/192

(58) Field of Classification Search ..... 89/191.01, 89/191.02, 192, 193
See application file for complete search history.

(56) References Cited

U.S. PATENT DOCUMENTS 3,859,745 A * 1/1975 Benelli ..... 42/16
4,531,446 A * 7/1985 VanVoorhees ..... 89/29
4,563,937 A * 1/1986 White ..... 89/185
4,872,392 A * 10/1989 Powers et al. ..... 89/193
5,218,163 A * 6/1993 Dabrowski ..... 89/193
5,247,758 A * 9/1993 Mason ..... 42/75.02
5,429,034 A * 7/1995 Badali et al. ..... 89/193
5,959,234 A * 9/1999 Scaramucci et al. ..... 89/193
6,227,098 B1 * 5/2001 Mason ..... 89/193
6,347,569 B1 * 2/2002 Butler ..... 89/191.01
6,382,073 B1 * 5/2002 Beretta ..... 89/193
6,508,160 B2 * 1/2003 Beretta ..... 89/191.02
6,564,691 B2 * 5/2003 Butler ..... 89/191.01
6,619,592 B2 * 9/2003 Vignaroli et al. ..... 89/191.01
6,622,610 B2 * 9/2003 Adkins ..... 89/193
6,848,351 B1 * 2/2005 Davies ..... 89/191.01
2001/0054350 A1 * 12/2001 Beretta ..... 89/191.02
2002/0073832 A1 * 6/2002 Vignaroli et al. ..... 89/191.01
2002/0139241 A1 * 10/2002 Butler ..... 89/191.01
2002/0178901 A1 * 12/2002 Bergstrom ..... 89/198

(Continued)

*Primary Examiner*—Michelle Clement
*Assistant Examiner*—Michael D David
(74) *Attorney, Agent, or Firm*—Bacon & Thomas, PLLC

(57) ABSTRACT

A semi-automatic rifle includes a frame (2); a barrel (3); a sliding guide (9) mounted in the frame (2) and forming one piece with breech bolts (10) which make it possible to control the recocking and the locking of the rifle (1); an automatic recock device (12) includes a piston (13) mounted in a gas cylinder (14) whose chamber (15) is connected to the bore (7) of the barrel (3) via a vent hole (16), whereby the piston (13) makes contact with the head of a sliding guide (17) which is connected to the sliding guide (9) and which is mounted in a sliding manner on a guiding rod (19) which forms one piece with the frame (2) and which is mainly parallel to the axis of the barrel (3). A floating mass (25) through which the guiding rod (19) passes is mounted in a sliding manner in the axial direction of the guiding rod (19) between two sides (27, 28) of a housing (24) in the head of the sliding guide (17) and a return spring (29) is mounted round the guiding rod (19) and situated between the frame (2) and the floating mass (25). The head of the sliding guide (17) is at least partially made of technical thermoplastic material.

10 Claims, 5 Drawing Sheets

U.S. PATENT DOCUMENTS

2003/0056778 A1* 3/2003 Schavone ..... 124/74
2003/0101979 A1* 6/2003 Schavone ..... 124/74
2005/0072415 A1* 4/2005 Schavone ..... 124/31
2007/0012169 A1* 1/2007 Gussalli Beretta ..... 89/193

* cited by examiner

SEMI-AUTOMATIC RIFLE

BACKGROUND OF THE INVENTION

A. Field

The invention concerns an improved semi-automatic rifle.

B. Brief Summary of the Invention

A semi-automatic rifle is provided with a gas intake recock device which allows for the automatic recock of the rifle when firing, i.e. which makes it possible to extract the cartridge casing out of the barrel chamber and to eject it on the one hand, and to feed a new cartridge into said chamber.

The recock device comprises a gas cylinder whose chamber is connected to the bore of the barrel via a vent hole and which contains a piston which makes contact with the moving parts and which can control the recock of the rifle.

The working principle of a semi-automatic rifle is based on the recovery of part of the gases, emitted as a result of the explosion of the cartridge powder, by the opening between the barrel and the gas cylinder, before the bullet of said cartridge has left the barrel, in other words high-pressure gases.

When the gases get into contact with the piston, they produce a shock effect which thrusts the moving parts to the rear and they also compress the spring placed behind the moving parts. The moving parts are connected to the locking device of the rifle and their backward movement guarantees the recock of the rifle.

The moving parts are stopped in their movement as they make contact with a shock absorber unit.

Due to the violent shock with the shock absorber, the moving parts tend to seriously rebound, which results in an immediate and very violent return of the moving parts.

Said rebound may result in malfunctions in the feeding of the next cartridge or in keeping the moving parts in their open position when the last cartridge is being fired.

In order to prevent said malfunctions, the moving parts are provided with a floating mass.

This floating mass is thrust to the rear simultaneously with the other moving parts as a result of the action of the piston, but it is free to follow its course after the other moving parts have been stopped as a result of the contact with the shock absorber.

Due to its inertia, the floating mass continues the backward movement and hits the other moving parts. As a result, the moving parts as a whole will be kept in the above-mentioned open position for a very brief moment so as to allow for the automatic ejection of the used cartridge casing and for the feeding of a new cartridge from the loader.

After said calculated delay, the return spring pushes all the moving parts to the front of the rifle again so as to load a new cartridge in the barrel chamber and to reassume said closed position, thus having the option to fire an additional shot.

The invention aims to simplify the automatic recock device and to improve its efficiency by reducing the weight at the front of the rifle so as to guarantee smoother movements for the rifle.

This aim is reached according to the invention by means of an improved semi-automatic rifle comprising a frame; a barrel; a sliding guide mounted in the frame and forming one piece with breech bolts which make it possible to control the recock and the locking of the rifle; an automatic recock device comprising a piston mounted in a gas cylinder whose chamber is connected to the bore of the barrel via a vent hole, whereby the piston makes contact with the head of a sliding guide which is connected to the sliding guide and which is mounted in a sliding manner on a guiding rod which forms one piece with the frame and which is mainly parallel to the axis of the barrel; a floating mass through which the guiding rod passes and which is mounted in a sliding manner in the axial direction of the guiding rod between two sides of a housing in the head of the sliding guide; and a return spring mounted round the guiding rod and situated between the frame and the floating mass, characterized in that the head of the sliding guide is at least partially made of technical thermoplastic material.

On the one hand, the selection of the technical thermoplastic material makes it possible to improve the shock absorbing capacities.

On the other hand, the low density of this material in comparison with the materials that are presently used makes it possible to reduce the general weight of the moving parts as a whole and thus the total weight of the rifle, and to also reduce the weight of the front part of the rifle, since the head of the sliding guide is situated in the front of the rifle.

Knowing that the relation between the weight of the head of the sliding guide and the weight of the moving parts is preferably a constant, the reduction of the weight of the head of the sliding guide also allows for the reduction of the weight of the floating mass which is part of the moving parts as a whole, which thus allows for an additional reduction in weight of the front part of the rifle and a more favorable relation between the weight of the moving parts and the weight of the floating mass.

According to a particular characteristic of the invention, the return spring is formed of a flat wire and not of a round wire, as is the case in most known semi-automatic rifles.

Thanks to the use of a flat wire, the working characteristics are improved, which implies that there will be less slackening. Moreover, the risk for the windings of the spring to be superimposed during the compression is excluded, and hence the break risk is reduced.

The flat wire also makes it possible to use the outer surface of the return spring as a sliding guide for the floating mass. This solution offers the chance to eliminate the guides and springs of the floating mass that are presently separate elements and to thus also reduce the weight of the front of the rifle even further.

DESCRIPTION OF THE DRAWINGS

For clarity's sake, the following embodiment of an improved semi-automatic rifle according to the invention is given hereafter as an example only without being limitative in any way, with reference to the accompanying drawings, in which:

FIG. 2 is a section to a larger scale of the part indicated by F2 in FIG. 1;

DETAILED DESCRIPTION OF PREFERRED EMBODIMENTS OF THE INVENTION

Figure 1:
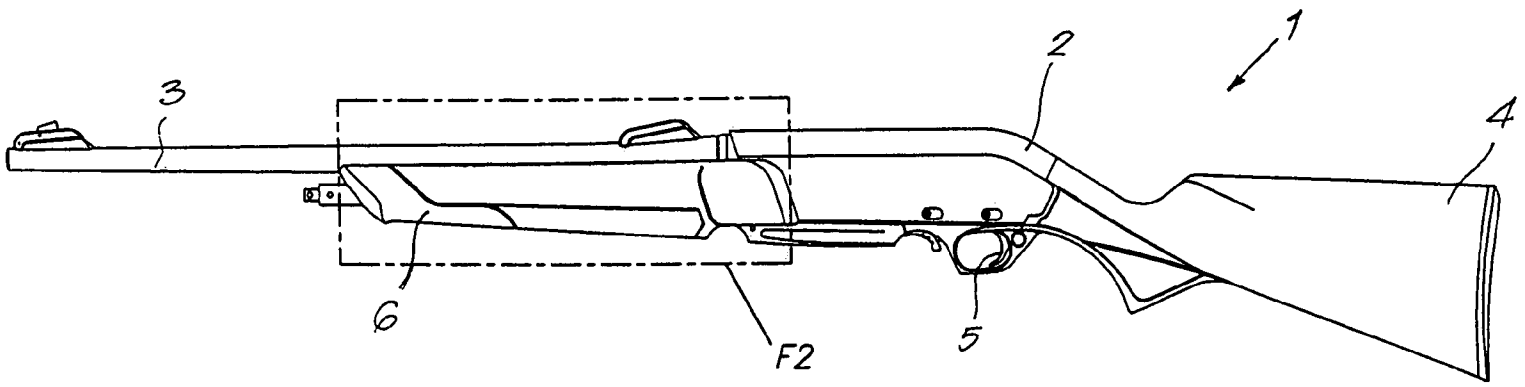
FIG. 1 is a side view of a semi-automatic rifle according to the invention.
Figure 6:
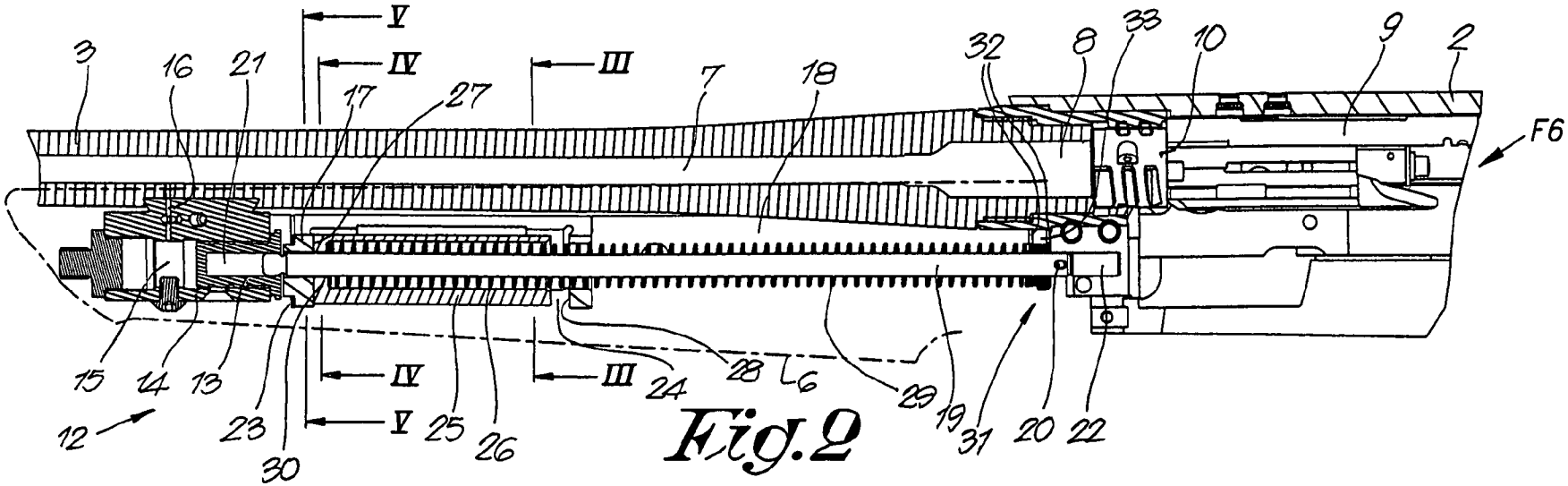
FIG. 6 is a view in perspective of the moving parts as a whole, indicated by F6 in FIG. 2.
Figure 3:
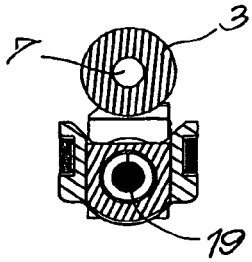
FIGS. 3 to 5 are sections according to lines III-III, IV-IV and V-V respectively of FIG. 2.
Figure 4:
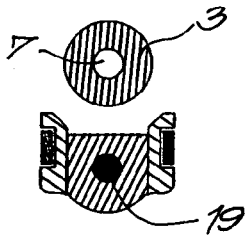
Figure 5:
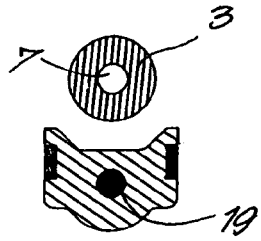
Figure 6:
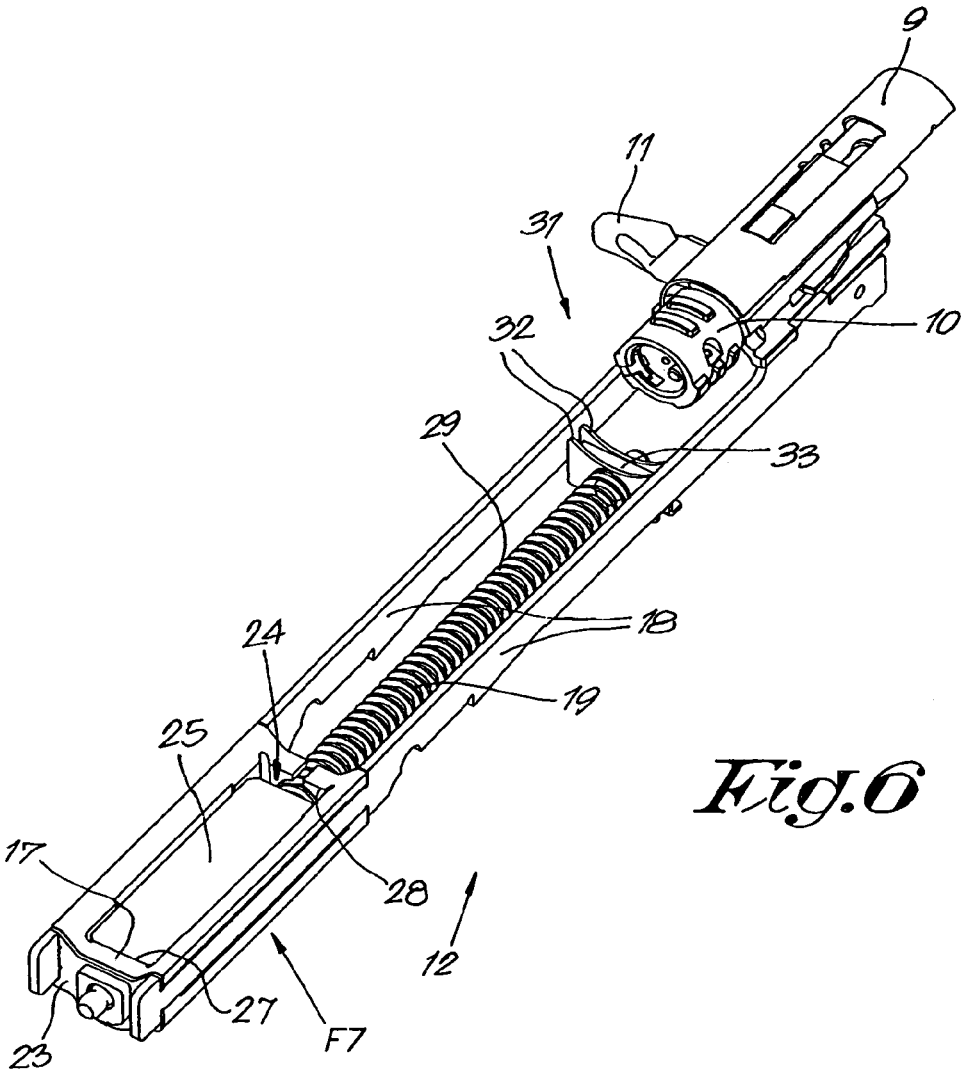
Figure 7:
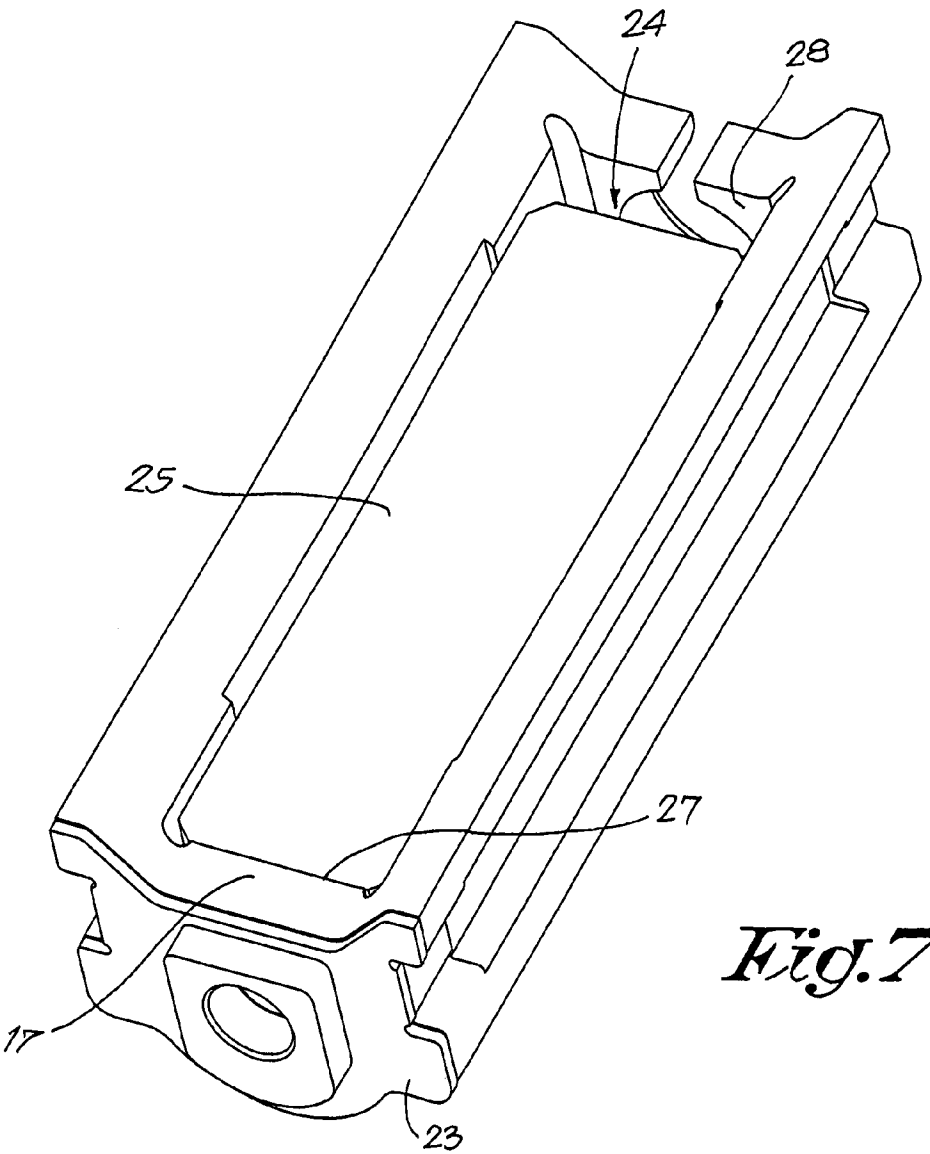
FIG. 7 is a view to a larger scale of the part indicated by F7 in FIG. 6.

The semi-automatic rifle 1, represented in the figures, comprises a frame 2, a barrel 3 mounted in the front of said frame 2, a butt at the back of the frame 2, a firing mechanism which is not represented, situated mainly inside the frame 1 and comprising a percussion mechanism controlled by a trigger 5, and a hand guard 6 to hold the rifle 1.

The barrel 3 forms one piece with the frame 2 and comprises a bore 7 with a chamber 8 having a larger diameter at the entry of the barrel 3, dimensioned for receiving a cartridge.

The firing mechanism comprises a feeding device to transfer a cartridge from a non-represented ammunition magazine in the chamber 8 of the barrel 2, whereby this device mainly comprises a first sliding guide 9 mounted in the frame 2 and which can slide in the axial extension of the barrel 3 between an open position which makes it possible to feed the cartridge into the chamber 8 and a closed position to enclose the cartridge in the chamber 8.

The sliding guide 9 forms one piece with (i.e., is connected rigidly with) a unit of breech bolts 10 which make it possible to lock the sliding guide 9 in its closed position, and with a loading lever 11 which makes it possible to manually activate the sliding guide 9 so as to load and extract the cartridges one shot after the other.

The firing mechanism also comprise an automatic recock device 12 which makes it possible to automatically activate the sliding guide 9 after a shot has been fired, so as to extract and eject the casing of the fired cartridge and to automatically reload a new cartridge.

As represented in FIG. 2, the automatic recock device 12 is covered by the hand guard 6 and comprises a piston 13 mounted in a gas cylinder 14 situated at a distance from the chamber 8 of the barrel 3 and whose chamber 15 is connected to the bore 7 of the barrel 3 by means of a vent hole 16.

The piston 13 makes contact with a mass designated as the head of a second sliding guide 17 which is connected to the sliding guide 9 as a whole by means of two rods 18 and which is mounted in a sliding manner on a guiding rod 19, one far end of which forms one piece with (i.e., is rigidly connected to) the frame 2 by means of a keeper pin 20, and the other far end of which is situated in a bore 21 of the piston 13 so as to form a stop for the movement of the piston 13.

The guiding rod 19 is situated mainly parallel to the axis of the barrel 3 and disposes of an abutment 22, called a frame spacer, which forms one piece with the frame 2.

The side of the head of the sliding guide 17 which makes contact with the piston 13 is reinforced with a reinforcement plate 23.

The head of the sliding guide 17 comprises a housing 24 for a floating mass 25 which comprises a bore 26 through which the guiding rod 19 passes, such that the floating mass 25 can freely slide in the axial direction of the guiding rod 19 between two sides 27 and 28 of the housing 24.

A return spring 29 is mounted round the guiding rod 19 and is provided between the frame 2 and the floating mass 25.

The return spring 29 tries to guarantee the contact between the floating mass 25 and the front side 27 of its housing 24 and thus to keep, by means of the rods 18, the sliding guide 9, breech bolt 10 and loading lever 11 as a whole in a closed position so as to lock the cartridge in the chamber 8 of the barrel 3.

To this end, the return spring rests on two abutments, i.e. at its front end on an abutment 30 inside the floating mass 25 and at the front end thereof, and at its other far end on an abutment 31 formed of two plates 32 and 30 and a shock absorber 33, which rests on the frame 2 itself.

Said abutment 31 is put in its position by the guiding rod 19 and the frame 2.

According to a characteristic of the invention, the return spring 29 is formed of a flat wire and the outer diameter of the return spring mainly corresponds to the inner diameter of the bore 26 of the floating mass 25, such that the outer surface of the return spring 29 can serve as a sliding guide for the floating mass 25.

The floating mass 29 is preferably also guided by the guiding rod 19 and the inner flanks of the head of the sliding guide 17.

According to another characteristic of the invention, the head of the sliding guide 17 is entirely or partly made of a technical thermoplastic material, for example a polymer or a fiberglass-reinforced polymer, treated to resist shocks.

The floating mass 25 is made of steel or another material having a similar density, for example a high-density polymer.

The working of the semi-automatic rifle 1 is illustrated by the FIGS. 2 and 8 to 11, which represent the situation at different successive firing stages.

FIG. 2 represents the situation where the moving parts are situated in a closed and locked position, ready to fire, when a cartridge is situated in the chamber 8 of the barrel 3.

When firing, a major pressure is felt in the bore 7 of the barrel 3 due to the gases produced while firing when the bursting charge of the cartridge is ignited.

Said pressure is also thrust into the vent hole 16 and thus into the gas cylinder 14. This provokes a movement of translation of the piston 13 which knocks against the head of the sliding guide 17.

The reinforcement plate 23, the head of the sliding guide 17 and the floating mass 25 together shift towards the frame 2, against the return spring 29.

Figure 8:
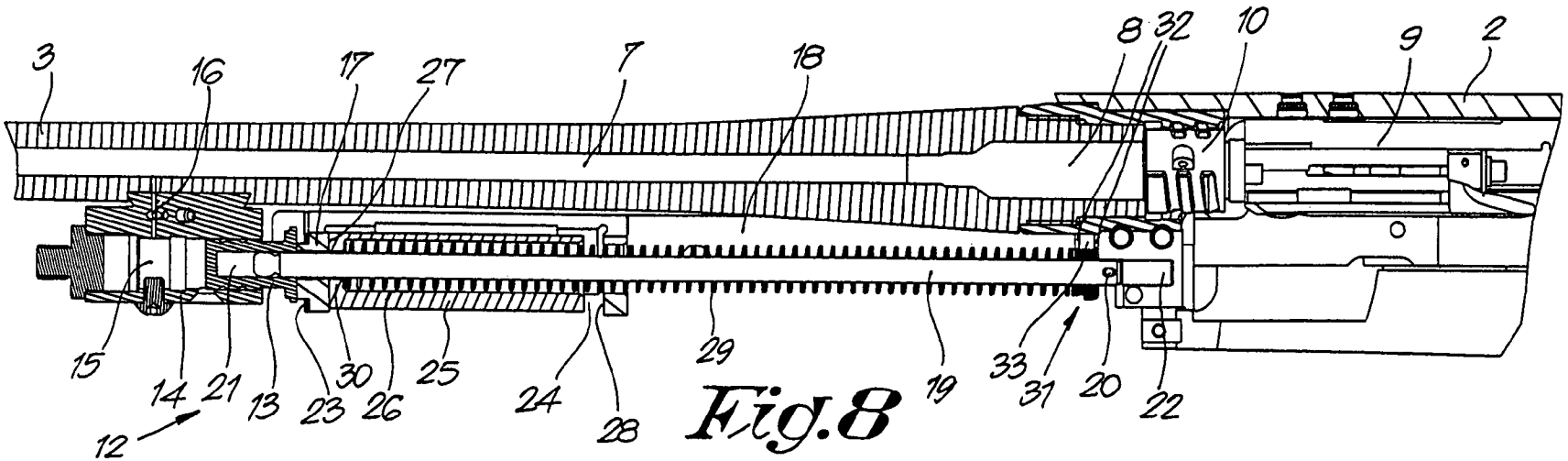
FIGS. 8 to 11 show the working of the rifle at different successive steps while firing.

FIG. 8 represents the position of the moving parts, immediately after a shot has been fired. The gases produced by the firing start to push the piston 13 back. The latter knocks against the reinforcement plate 23 and the head of the sliding guide 17, forcing the sliding guide 9 to go back by means of the rods 18 and forcing the breech bolts 10 to unlock themselves from the barrel 3.

Figure 9:
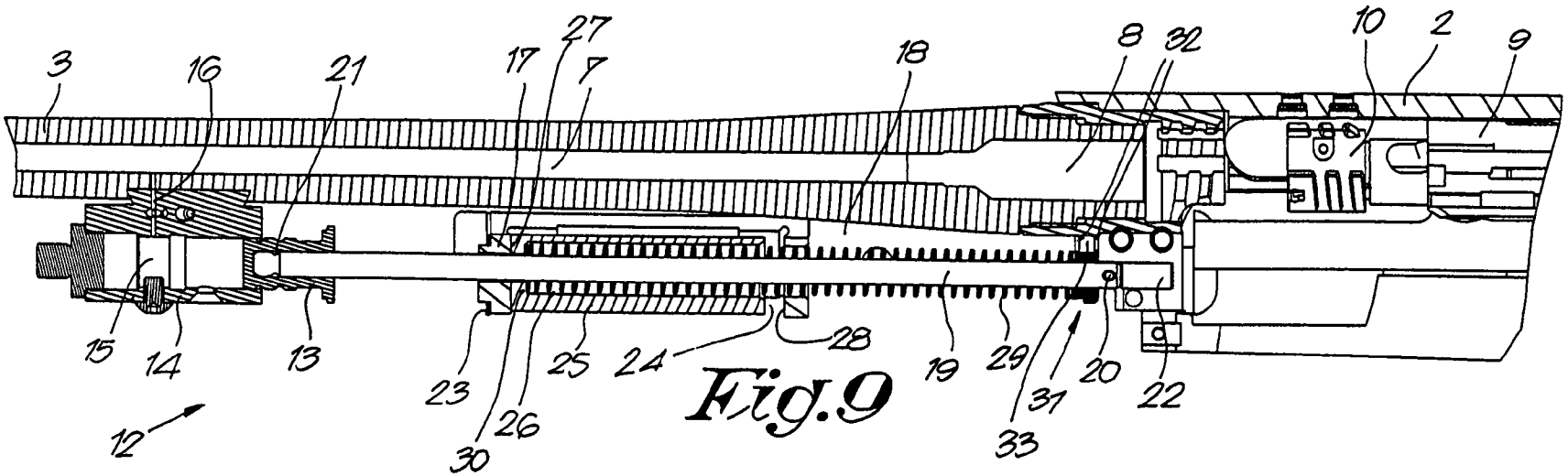

FIG. 9 shows the end of the movement of the piston 13. It is stopped in its axial movement by one far end of the guiding rod 19. The moving parts 9, 10, 11, 17, 18 and 23 all follow their course thanks to the energy transmitted by the shock with the piston 13.

Figure 10:
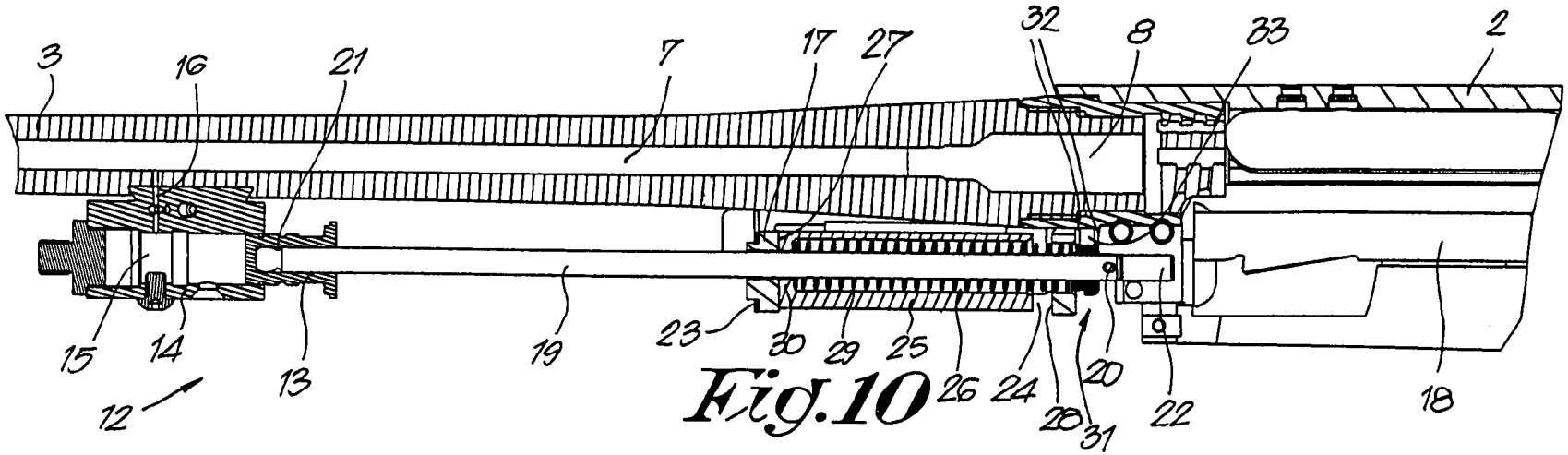

When the moving parts have all completed their course, the head of the sliding guide 17 comes knocking against the abutment 31, formed of the two plates 32 and the shock absorber 33, as represented in FIG. 10, which shows the instant when the head of the sliding guide 17 makes contact with the abutment 31.

Said recoil movement of the moving parts 9-10-11-17-18-23 makes it possible to extract the casing of the fired cartridge out of the chamber 8.

Figure 11:
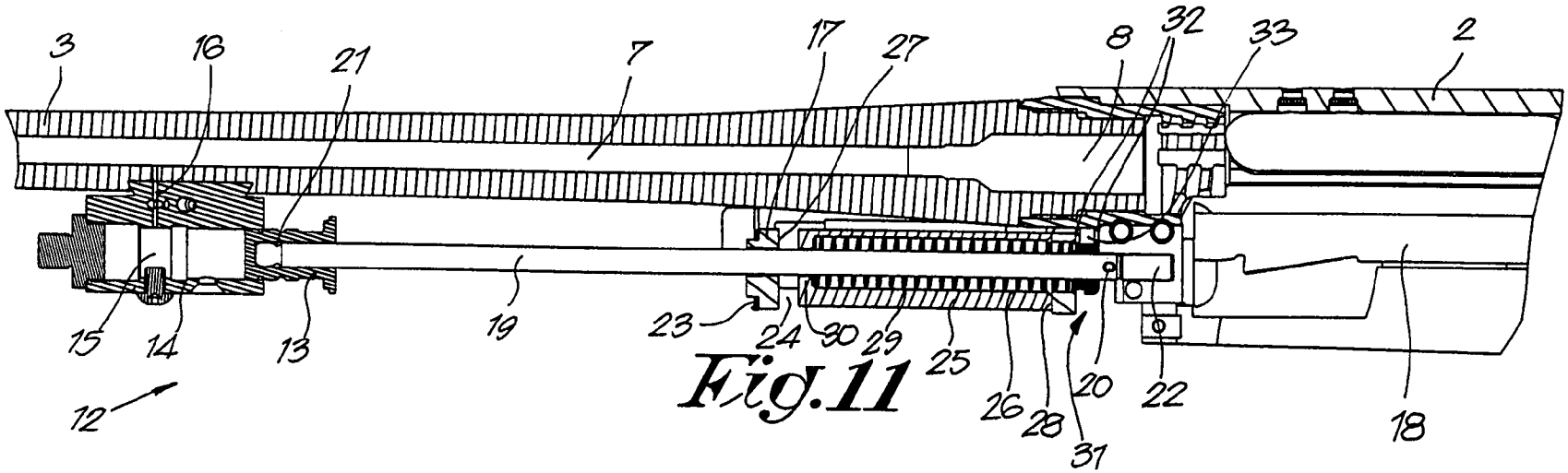

Due to its inertia, the floating mass 25 continues its shift towards the frame 2 and knocks against the rear inside 28 of the head of the sliding guide 17, as is represented in FIG. 11.

As a result, for a very brief moment, the moving parts 9-10-11-17-18-23 are all maintained in the so-called open position.

In this phase, the cartridge casing is ejected from the rifle 1. The cartridges present in the ammunition loader stabilize.

After said calculated delay, the return spring 29 pushes the moving parts 9-10-11-17-18-23 all to the front of the rifle 1 again so as to automatically feed a new cartridge from the loader into the chamber 8, and it reassumes the so-called closed position, thus having the option to fire an additional shot.

The material selection for the head of the sliding guide 17 and the floating mass 25 is important for the principle of the floating mass 25 and thus of the calculated delay to work well.

It is clear that many modifications can be made to the above-described example while still remaining within the scope of the invention, as described in the following claims.

The invention claimed is:

1. Semi-automatic rifle comprising a frame (2); a barrel (3); a first sliding guide (9) mounted in the frame (2) and connected rigidly with breech bolts (10) arranged to enable control of the recocking and the locking of the rifle (1); an automatic recock device (12) comprising a piston (13) mounted in a gas cylinder (14) whose chamber (15) is connected to the bore (7) of the barrel (3) via a vent hole (16), wherein the piston (13) makes contact with the head of a second sliding guide (17) which is connected to the first sliding guide (9) and which is mounted in a sliding manner on a guiding rod (19) which is rigidly connected with the frame (2) and which extends mainly parallel to the axis of the barrel (3); a floating mass (25) through which the guiding rod (19) passes and which is mounted in a sliding manner in the axial direction of the guiding rod (19) between two sides (27, 28) of a housing (24) in the head of the second sliding guide (17); and a return spring (29) mounted round the guiding rod (19) and situated between the frame (2) and the floating mass (25), and wherein the head of the second sliding guide (17) is at least partially made of shock resistant thermoplastic material.

2. Semi-automatic rifle according to claim 1, wherein the head of the second sliding guide (17) is entirely made of shock resistant thermoplastic material.

3. Semi-automatic rifle according to claim 1, wherein the shock resistant thermoplastic material of the second sliding guide (17) is a polymer.

4. Semi-automatic rifle according to claim 1, wherein the shock resistant thermoplastic material of the head of the second sliding guide (17) is a fiberglass-reinforced polymer treated to resist shocks.

5. Semi-automatic rifle according to claim 1, wherein the floating mass (25) is made of steel or another material having a similar density.

6. Semi-automatic rifle according to claim 5, wherein the floating mass (25) is made of a high-density polymer.

7. Semi-automatic rifle according to claim 1, wherein the return spring (29) is formed of a flat wire.

8. Semi-automatic rifle according to claim 7, wherein the outer surface of the return spring (29) serves as a sliding guide for the floating mass (25).

9. Semi-automatic rifle according to claim 8, wherein the return spring (29) is situated in a bore (26) of the floating mass (25) and the inner diameter of the bore (26) essentially corresponds to the outer diameter of the return spring (29).

10. Semi-automatic rifle according to claim 7, wherein the floating mass (25) is provided with an abutment (30) at its front end which serves as a support for the front end of the return spring (29).

* * * * *